United States Patent [19]

Steiner

[11] 4,343,500

[45] Aug. 10, 1982

[54] FLOOR IMBEDDED DOOR BOLT

[75] Inventor: John W. Steiner, Millville, N.J.

[73] Assignee: Thunderbolt Corporation, Millville, N.J.

[21] Appl. No.: 151,900

[22] Filed: May 21, 1980

[51] Int. Cl.[3] ..... E05C 1/10

[52] U.S. Cl. ..... 292/175; 292/150; 292/DIG. 15; 292/144

[58] Field of Search ..... 292/175, 251.5, 144, 292/150, 189, DIG. 4, DIG. 15

[56] References Cited

U.S. PATENT DOCUMENTS

| | | | |
|---|---|---|---|
| 2,497,697 | 2/1950 | Smith | 292/251.5 X |
| 2,809,062 | 10/1957 | Mainhardt | 292/144 |
| 3,330,585 | 7/1967 | Pollin | 292/164 |
| 3,563,586 | 2/1971 | Creamer | 292/144 |
| 4,183,565 | 1/1980 | Allemann | 292/150 |
| 4,227,726 | 10/1980 | Sorimachi | 292/251.5 |

*Primary Examiner*—Richard E. Moore

*Attorney, Agent, or Firm*—Thomas A. Lennox

[57] ABSTRACT

A security door stop bolt mounted in the floor preventing entrance through the door including a tube housing imbedded in the floor with a door stop sliding in the tube, nestled in the tube when not in use but raised with a manual lifting means to prevent inadvertent triggering of the stop bolt with a carpet cut out attached to the top of the door stop to hide the entire mechanism.

8 Claims, 6 Drawing Figures

FLOOR IMBEDDED DOOR BOLT

BACKGROUND OF THE INVENTION

This invention relates to a security door stop which is mounted in the floor inside a door which opens and swings to the inside of the structure to be protected. This invention protects any structure for which unauthorized entrance is to be prevented and is particularly suitable for homes, apartments and the like where the occupant wishes to remain secure from persons entering a particular door. The door stop bolt and mechanism is positioned so as to be out of the reach of anyone attempting entrance through the door. Typically, the door stop bolt is positioned close to the door in the closed position and reasonably near the free end of the bottom of the door. Thus, although the door may be opened slightly, it will almost immediately come in contact with the door stop bolt that has been raised for protection. The bolt will be out of reach of the intruder as it may be positioned close enough to the door to prevent the intruders hand or any device to be slipped through the door opening. It is also possible to place the door stop at a position away from the open free end of the bottom of the door so that an intruder's hand or a device cannot effectively reach the door stop bolt, even if the door is slightly open. U.S. Pat. No. 321,645 to C. A. Schmidt describes a spring loaded door check. In U.S. Pat. No. 1,866,233 R. Tarrant describes a door stop and alarm which is again spring loaded. A window sash retainer is described in U.S. Pat. No. 1,884,484 to J. Yacomis. In U.S. Pat. No. 3,330,585 to W. T. Pollin a spring loaded door stop is engaged with a release lever.

There is a continuing need to provide a security door stop which may be engaged by the occupant of a structure to essentially insure that unauthorized persons will be unable to enter through a door. It is advantageous to have the door stop imbedded in the floor to obtain the maximum strength of the bolt. A floor imbedded door stop may be constructed of heavy tubular materials and of a size that could not be easily used in the door jam. In addition, the floor provides a strength and rigidity well in excess that of the typical door jam. However, the appearance and safety problems associated with the prior floor imbedded door stops are significant. The positioning of the floor imbedded door stop is such that it is directly in the line of travel with those entering the door. In addition, a floor imbedded door stop is reachable by all members of the family in the structure including small children therefore, safety of such devices must be a prime consideration.

It is an object of this invention to provide a security door stop bolt that can be imbedded in any type of floor including a concrete floor.

It is an additional object of this invention to provide a security door stop bolt that will not easily break or jam in either the retracted position or in the upright locked position.

It is a further object of this invention to provide a security door stop bolt that provides absolute safety even when a small child playing with it on the floor.

It is an additional object of this invention to provide a security door stop bolt that cannot be triggered accidentally to spring upwardly into its locked position at some time when there is no person in the structure.

It is an additional object of this invention to provide a security door stop bolt that is not easily visible even by persons entering through the door in which it is mounted.

It is a further object of this invention to provide a door stop bolt mounted in the floor which is quiet in use and may be easily and readily raised into its locked position.

These and other objects not satisfied by the prior art devices are attained by the following invention.

SUMMARY OF THE INVENTION

My invention is a security door stop bolt to be mounted and imbedded in the floor inside a typical door swinging to the inside of the structure to be protected. The term "structure" as used throughout this disclosure is intended to include not only homes but also apartments, and even inside rooms, such as hotel rooms and the like. The security door stop bolt is mounted in the floor in such a position as to be out of the reach of anyone attempting entrance through the door. It is preferred that it be placed sufficiently near the inside surface of the door that when the door is partially opened, that inside surface will rest against the door stop bolt in its raised position while the outside surface of the door has still not cleared the door jam. The door stop bolt includes a housing with a tube depending therefrom which is imbedded in the floor. The term "tube" is used throughout this disclosure is intended to be of any suitable shape, preferably cylindrical although it may be square, triangular, hexagonal or any suitable cross-sectional shape. The housing preferably includes a flange which is firmly and structurally connected to the floor, preferably of a thickness about equal to the carpet pad normally placed under indoor carpeting. The door stop has a top and slidably fits in the tube of a length to fit entirely within the tube below the upper surface to fit entirely within the tube below the upper surface of the floor. This door stop in its rest position with no spring loading is entirely within the tube and is not spring loaded. A lifting device is provided to manually grasp the door stop and lift it to a height above the door surface sufficient to prevent the door from being pushed open into the inside area. A retractable stop post device is provided to hold the door stop at the upraised height after it has been manually lifted to that position. The stop post device is preferably springably loaded to extend outward automatically from the stop when the post is lifted above the top of the tube housing. An attachment system is provided to fix a cut-out of carpet matching the carpet on the floor of the same shape as the top of the door stop housing. It is preferred to attach the carpet with a ferrous metal fastener and that the lifting means be a magnet.

DESCRIPTION OF PREFERRED EMBODIMENTS

Figure 1:
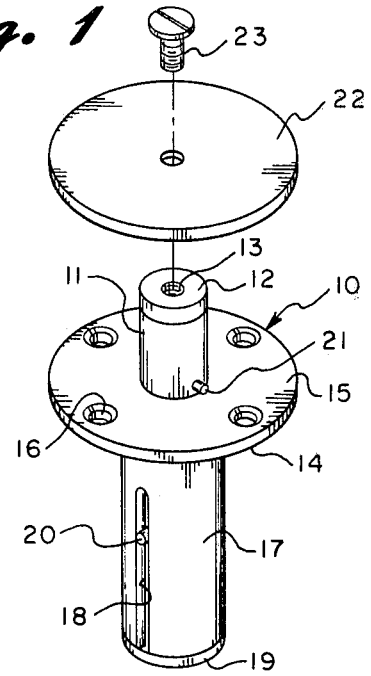
FIG. 1 is a perspective view of the security door stop bolt of this invention.

Door stop system 10 is schematically pictured in the perspective view of FIG. 1. Door stop bolt 11 is a one inch steel pipe with one-quarter inch sidewalls equipped with steel top 12 having threaded hole 13 near the center. Bolt 11 slidably fits in housing 14 including flange 15 of one-quarter inch thick steel with one-quarter inch holes 16 tapered to fit heavy wood screws for direct attachment to a wooden floor. Cylindrical pipe 17 welded to flange 15 has a inside diameter slightly larger than one inch is constructed of one-quarter inch steel with longitudinal slot 18 extending upwardly from bottom 19 to receive lower stop post 20. Bottom 19 is rigidly fixed to the bottom of tube 17 and prevents bolt 11 from falling downwardly out of the system. Upper stop post 21 is illustrated in its extended locking position holding bolt 11 in its raised position as stop 21 rests on the top of flange 15. Carpet cover 22 and bolt 23 are shown exploded for clarity.

Figure 2:
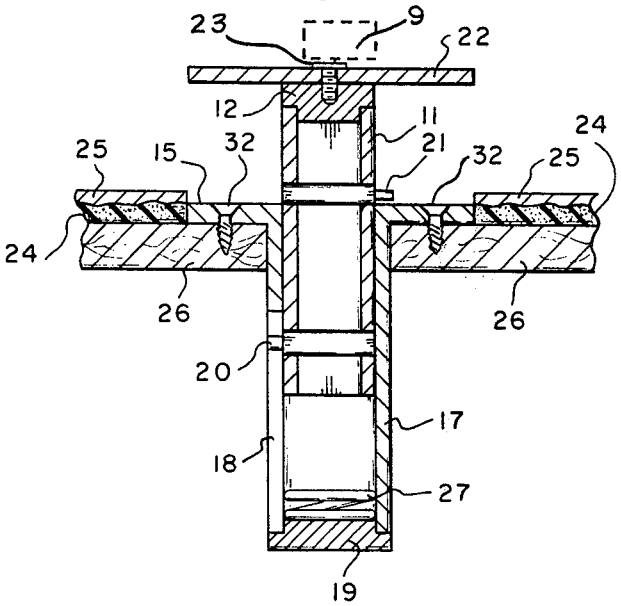
FIG. 2 is a cross-sectional view along lines 2—2 of FIG. 1 of the security door stop bolt in the upraised position to prevent the door from being opened with the carpet piece added.

In FIG. 2, a cross-sectional view of door stop system 10 shown in FIG. 1 is provided with a carpet cover 22 secured on top 12 with flat head bolt 23. Carpet swatch 22 is shaped to fit over and cover not only top 12 but also the top of flange 15. The thickness of flange 15 is approximately the thickness of carpet pad 24 under the balance of carpet 25. Flange 15 is securely fastened to floor 26 with wood screws 27 to hold tube 17 in position. Bolt 11 slides up and down inside tube 17 with lower stop post 20 preventing inadvertent removal and upper stop post 21 extending to hold bolt 11 in its raised locked position as stop 21 rests on the top of flange 15. Carpet cover 22 and bolt 23 are shown exploded for clarity.

Figure 3:
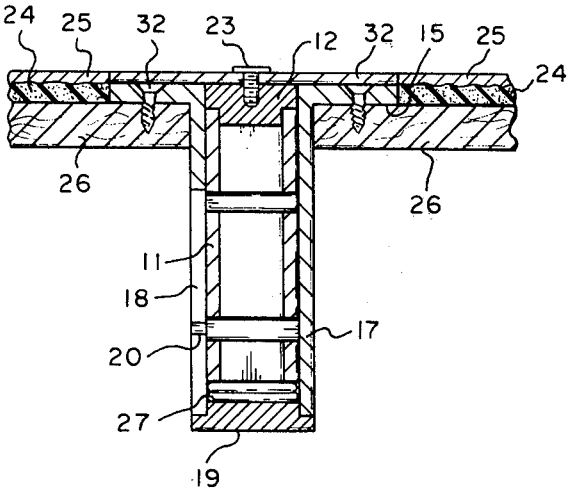
FIG. 3 is a cross-sectional view of the device of FIG. 2 with the security door stop bolt in its retracted hidden position in the floor.
Figure 4:
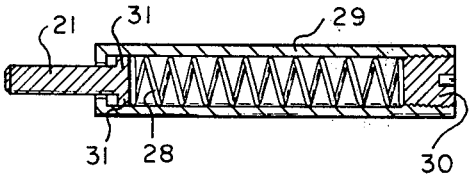
FIG. 4 is an expanded cross-sectional view of a stop post to hold the door stop in its upraised position.
Figure 5:
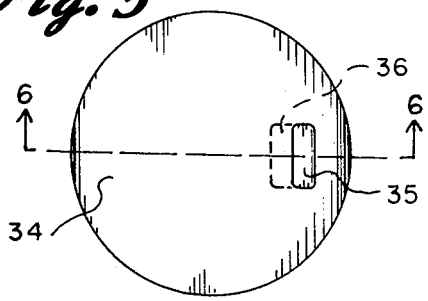
FIG. 5 is a top view of an alternative top to the door stop providing a hidden lifting device.
Figure 6:
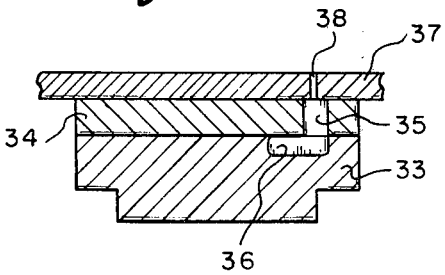
FIG. 6 is an expanded cross-sectional view along lines 6—6 of FIG. 5 of the top of the security door stop bolt showing the under cut recess by which the door stop is lifted.

In FIG. 2, a cross-sectional view of door-stop system 10 shown in FIG. 1 is provided with carpet cover 22 secured on top 12 with flat head bolt 23. Carpet swatch 22 is shaped to fit over and cover not only top 12 but also the top of flange 15. The thickness of flange 15 is approximately the thickness of carpet pad 24 under the balance of carpet 25. Flange 15 is securely fastened to floor 26 with wood screws 27 to hold tube 17 in position. Bolt 11 slides up and down inside tube 17 with lower stop post 20 preventing inadvertent removal and upper stop post 21 extending to hold bolt 11 in its raised locked position to prevent the door from being opened. Spring 27 rests on bottom 19 to reduce noise when bolt 11 is dropped to its rest position, but is chosen to provide insufficient force to raise bolt 11 above the floor level. Spring 19 may be replaced by resiliant foam or other like material. The weight of bolt 11 allows top 12 to rest at a level at the top of flange 15. In FIG. 3, bolt 11 is shown in its downward position out of the way of the swinging door. From above, carpet swatch 22 completely covers flange 15 and stop system 10. Bolt 11 rests against spring 27 with the weight of bolt 11 and top 12 being sufficient to slightly compress spring 27 against bottom 19. In this position lower stop post 20 continues as extended riding in slot 18 while upper stop post 21 has been pressed inwardly and is riding against the inside surface of tube 17. Upper stop post 21 is pressed against spring 28 as shown in FIG. 4 to disengage the stop to allow bolt 11 to be lowered. The relative size of upper post 21 as illustrated, may be depressed and disengaged to lower bolt 11 by pushing with a finger or the edge of a shoe. It is preferred that the size of post 21 be chosen to allow it to be easily depressed with the side of a shoe allowing bolt 11 to drop to the hidden position. In FIG. 4, the mechanism of upper stop post 21 is shown in cross-section with housing 29 containing spring 28 with end 30. Shoulders 31 on stop post 21 prevent the post from leaving housing 29. The mechanism for lower stop post 20 is identical to that shown in FIG. 4. If it is desired to entirely remove bolt 11 from housing 14, a thin piece of metal (not shown) is inserted downwardly between bolt 11 and tube 17 depressing lower stop post 20 and allowing bolt 11 to be completely removed. Flat head bolt 23 is of ferrous metal and the preferred method of lifting bolt 11 to its upright position is by fixing magnet 9 on bolt 23 and lifting bolt 11 into its upright position. Magnet 9 is attached to rod 40 for ease of lifting. An alternative device for allowing bolt 11 to be raised is shown in FIGS. 5 and 6. Top 12 of system 10 is replaced with a two piece top comprising lower disc 33 welded to the upper end of door stop bolt 11 and disc plate 34 welded in turn on the upper surface of disc 33. Plate 34 is equipped with slot 35 which opens into cavity 36 in lower disc 33 having a horizontal area greater than slot 35. Carpet swatch 37 of a size to cover flange 15 is adhesively fastened to the top of plate 34. Slit 38 in carpet 37 allows an "L" shaped metal rod (not shown) to be inserted through slit 38, into slot 35 and into cavity 36. By turning the rod slightly it will engage the undercut of cavity 36 and allow bolt 11 to be easily lifted into its upright locking position.

While my invention is described with particularity as to material, shape and size, it should be understood that the specifics are not critical to this invention. The patent is intended to include modification and changes which may come within and extend from the following claims:

I claim:

1. A security door stop bolt for mounting in a carpet covered floor area located inside a door swinging to the inside of the structure to be protected, the bolt being out of the reach of anyone attempting entrance through the door comprising:

(a) a housing comprising a first attachment means to secure the housing to a floor and a tube depending therefrom imbedded in the floor, (b) a door stop with a top slidably fitting in the tube below the upper surface of the floor, (c) a lifting means to manually grasp the door stop and lift it to a height above the floor surface to prevent the door from being pushed open into the inside area, (d) a retractable stop post means to hold the door stop at the upraised height, and (e) a second attachment means to secure on top of the door stop, a cut out of carpet of the same shape as the top of the door stop housing.

2. The security door stop bolt of claim 1 wherein the bolt is constructed to mount on a carpet and pad covered floor and the housing comprises a flange securely attached to the top of the floor with the flange being of a thickness approximately equivalent to a carpet pad on the floor.

3. The security door stop of claim 1 wherein the tube is cylindrical and the stop is cylindrical, sliding inside the tube of the housing.

4. The security door stop of claim 1 wherein a ferrous metal attachment means is used to fix the cut out of carpet to the top of the door stop and the lifting means comprises a magnet.

5. The security door stop of claim 1 wherein the housing includes a bottom wall on which a spring means rests providing a bias pressure on the door stop when it is lowered to the storage position wherein the bias pressure is sufficient to reduce the force of dropping the door stop against the bottom of the housing, but insufficient bias pressure to cause the door stop to rest above the level of the upper surface of the floor.

6. The security door stop bolt of claim 1 wherein a vertical slot is provided along one side of the housing having an upper termination end, and a guide means is provided extending horizontally from the door stop slidably riding in the slot as the door stop is raised and lowered, wherein the height of the termination end is chosen to allow the retractable stop post to extend out above the housing when the door stop is raised.

7. The security door stop bolt of claim 1 wherein the lifting means is the combination of the attachment means being of ferrous metal and a magnet manually allowed to magnetically adhear to the attachment means.

8. The security door stop bolt of claim 1 wherein the cut out of carpet matches a carpet covered floor area into which the housing is imbedded.

* * * * *